US005353938A

United States Patent [19]

LaGrange et al.

[11] Patent Number: 5,353,938

[45] Date of Patent: Oct. 11, 1994

[54] METHOD OF SORTING OBJECTS

[75] Inventors: Hervé LaGrange, Paris; Patrick Harrouet, Bagneux, both of France

[73] Assignee: Compagnie Generale d'Automatisme CGA-HBS, Bretigney sur Orge, France

[21] Appl. No.: 945,949

[22] Filed: Sep. 17, 1992

[30] Foreign Application Priority Data

Sep. 18, 1991 [FR] France ..... 91 11510

[51] Int. Cl.[5] ..... B07C 5/02

[52] U.S. Cl. ..... 209/584; 209/900; 271/3

[58] Field of Search ..... 209/563, 564, 569, 583, 209/584, 900; 271/3, 3.1, 4; 414/788.1

[56] References Cited

U.S. PATENT DOCUMENTS

| | | | |
|---|---|---|---|
| 4,247,008 | 1/1981 | Dobbs | 209/900 X |
| 4,388,994 | 6/1983 | Suda et al. | 209/900 X |
| 4,921,109 | 5/1990 | Hasuo et al. | 209/583 X |
| 5,009,321 | 4/1991 | Keough | 209/900 X |
| 5,097,959 | 3/1992 | Tilles et al. | 209/900 X |
| 5,097,960 | 3/1992 | Tilles et al. | 209/900 X |
| 5,119,954 | 6/1992 | Svyatsky et al. | 209/900 X |

FOREIGN PATENT DOCUMENTS

| | | |
|---|---|---|
| 2555474 | 5/1985 | France . |
| 2565852 | 12/1985 | France . |
| 2225999 | 6/1990 | United Kingdom . |

*Primary Examiner*—D. Glenn Dayoan
*Assistant Examiner*—Tuan N. Nguyen
*Attorney, Agent, or Firm*—Sughrue, Mion, Zinn, Macpeak & Seas

[57] ABSTRACT

The present invention concerns a method of sorting objects in N passes into R receptacles. The method includes the following steps:

recording information comprising N criteria per object, classifying the objects in memory in a given order, so as to assign each of the objects to a destination, calculating the distribution of the objects in a (N−1)'th canonical pass to assign all of the objects that have the same values of a first criterion to the same receptacle, calculating the distribution in an N'th canonical pass to assign all the objects that have the same value of a second criterion to the same receptacle in the given order, modifying the distribution of said N'th canonical pass, to provide a modified distribution of the N'th pass such that each receptacle contains P objects at the most, (P being the maximum contents of each receptacle), determining the contents of each receptacle at the end of a provisional (N−1)'th pass, performed in such a manner as to allow the modified distribution of the N'th pass, modifying the distribution of the N'th modified pass, providing a definitive distribution of the N'th pass, if the contents of a receptacles of the provisional (N−1)'th pass, exceeds P, the order of the objects preserving the given order and that the distribution of a definitive (N−1)'th pass is performed in such a manner as to allow the distribution of the definitive N'th pass leads to the receptacles each containing at most P objects, repeating all the preceding steps for the (N−1)'th and (N−2)'nd passes, and so on until the last two passes, sorting the objects according to the definitive distributions.

14 Claims, 7 Drawing Sheets

FIG.5

| C0 | C1 | C2 | C3 | C4 | C5 | C6 | C7 | C8 | C9 | |
|---|---|---|---|---|---|---|---|---|---|---|
| B0 | B1 | B2 | B3 | B4 | B5 | B6 | B7 | B8 | B9 | L0 |
| B10 | B11 | B12 | B13 | B14 | B15 | B16 | B17 | B18 | B19 | L1 |
| B20 | B21 | B22 | B23 | B24 | B25 | B26 | B27 | B28 | B29 | L2 |
| B30 | B31 | B32 | B33 | B34 | B35 | B36 | B37 | B38 | B39 | L3 |
| B40 | B41 | B42 | B43 | B44 | B45 | B46 | B47 | B48 | B49 | L4 |
| B50 | B51 | B52 | B53 | B54 | B55 | B56 | B57 | B58 | B59 | L5 |
| B60 | B61 | B62 | B63 | B64 | B65 | B66 | B67 | B68 | B69 | L6 |
| B70 | B71 | B72 | B73 | B74 | B75 | B76 | B77 | B78 | B79 | L7 |
| BF1 | BF2 | BF3 | BF4 | BF5 | BF6 | BF7 | BF8 | BF9 | BF10 | L8 |
| BF11 | BF12 | BF13 | BF14 | BF15 | BF16 | BF17 | BF18 | BF19 | BF20 | L9 |

FIG.6

C0 ---- ---- C9

| | | | | | | | | | | |
|---|---|---|---|---|---|---|---|---|---|---|
| B0 | B1 | B2 | B3 | B4 | B5 | B6 | B7 | B8 | B9 | L0 |
| B10 | B11 | B12 | B13 | B14 | B15 | B16 | BF1 | BF2 | BF3 | ⋮ |
| B17 | B18 | B19 | B20 | B21 | B22 | BF4 | BF5 | BF6 | BF7 | |
| B23 | B24 | B25 | B26 | B27 | B28 | B29 | B30 | BF8 | BF9 | |
| B31 | B32 | B33 | B34 | B35 | B36 | B37 | BF10 | BF11 | BF12 | |
| B38 | B39 | B40 | B41 | B42 | B43 | B44 | B45 | B46 | BF13 | |
| B47 | B48 | B49 | B50 | B51 | B52 | B53 | B54 | BF14 | BF15 | |
| B55 | B56 | B57 | B58 | B59 | B60 | B61 | BF16 | BF17 | BF18 | |
| B62 | B63 | B64 | B65 | B66 | B67 | B68 | B69 | B70 | BF19 | ⋮ |
| B71 | B72 | B73 | B74 | B75 | B76 | B77 | B78 | B79 | BF20 | L9 |

FIG.7

C0 ----- ----C9

| | | | | | | | | | | |
|---|---|---|---|---|---|---|---|---|---|---|
| B0 | B1 | B2 | B3 | B4 | B5 | B6 | B7 | B8 | B9 | L0 |
| B10 | B11 | B12 | B13 | B14 | B15 | B16 | BF1 | BF2 | BF3 | ⋮ |
| B17 | B18 | B19 | BF4 | B20 | B21 | B22 | BF5 | BF6 | BF7 | |
| B23 | B24 | B25 | B26 | B27 | B28 | B29 | B30 | BF8 | BF9 | |
| B31 | B32 | B33 | B34 | B35 | B36 | B37 | BF10 | BF11 | BF12 | |
| B38 | B39 | B40 | B41 | B42 | B43 | B44 | B45 | B46 | BF13 | |
| B47 | B48 | B49 | B50 | B51 | B52 | B53 | B54 | BF14 | BF15 | |
| B55 | B56 | B57 | B58 | B59 | B60 | B61 | BF16 | BF17 | BF18 | |
| B62 | B63 | B64 | B65 | B66 | B67 | B68 | B69 | B70 | BF19 | ⋮ |
| B71 | B72 | B73 | B74 | B75 | B76 | B77 | B78 | B79 | BF20 | L9 |

FIG.8

C0---- ----C9

| | | | | | | | | | | |
|---|---|---|---|---|---|---|---|---|---|---|
| B0 | B1 | B2 | B3 | B4 | B5 | B6 | B7 | B8 | B9 | L0 |
| B10 | B11 | B12 | B13 | B14 | B15 | B16 | BF1 | BF2 | BF3 | ⋮ |
| B17 | BF5 | B18 | BF4 | B19 | B20 | B21 | B22 | BF6 | BF7 | |
| B23 | B24 | B25 | B26 | B27 | B28 | B29 | B30 | BF8 | BF9 | |
| B31 | B32 | B33 | B34 | B35 | B36 | B37 | BF10 | BF11 | BF12 | |
| B38 | B39 | B40 | B41 | B42 | B43 | B44 | B45 | B46 | BF13 | |
| B47 | B48 | B49 | B50 | B51 | B52 | B53 | B54 | BF14 | BF15 | |
| B55 | B56 | B57 | B58 | B59 | B60 | B61 | BF16 | BF17 | BF18 | |
| B62 | B63 | B64 | B65 | B66 | B67 | B68 | B69 | B70 | BF19 | ⋮ |
| B71 | B72 | B73 | B74 | B75 | B76 | B77 | B78 | B79 | BF20 | L9 |

FIG.9

C0 ---- ---- C9

| | | | | | | | | | | |
|---|---|---|---|---|---|---|---|---|---|---|
| B0 | B1 | B2 | B3 | B4 | B5 | B6 | B7 | B8 | B9 | L0 |
| B10 | B11 | B12 | B13 | B14 | B15 | BF1 | B16 | BF2 | BF3 | ⋮ |
| B17 | B18 | B19 | B20 | B21 | B22 | BF4 | BF5 | BF6 | BF7 | |
| B23 | B24 | B25 | B26 | B27 | B28 | B29 | B30 | BF8 | BF9 | |
| B31 | B32 | B33 | B34 | B35 | B36 | B37 | BF10 | BF11 | BF12 | |
| B38 | B39 | B40 | B41 | B42 | B43 | B44 | B45 | B46 | BF13 | |
| B47 | B48 | B49 | B50 | B51 | B52 | B53 | B54 | BF14 | BF15 | |
| B55 | B56 | B57 | B58 | B59 | B60 | B61 | BF16 | BF17 | BF18 | |
| B62 | B63 | B64 | B65 | B66 | B67 | B68 | B69 | B70 | BF19 | ⋮ |
| B71 | B72 | B73 | B74 | B75 | B76 | B77 | B78 | B79 | BF20 | L9 |

METHOD OF SORTING OBJECTS

The invention relates to a method of sorting objects, in particular sorting mail in a sorting office.

In all that follows the example of sorting given is sorting mail. However, the reader will clearly understand that this example is not limiting and that the method of the invention is applicable to sorting any objects.

The spread of automatic processing of mail has involved development of sorting machines for small sorting offices, effecting what is called dispatch sorting and distribution sorting, which is the last son to be effected before the distribution of the mail to the users by the postmen. Distribution sorting is moreover also called preparation of the postman's walk. In the machines initially conceived, the mail is sorted into a certain number of destinations and each destination is associated with a receptacle of the machine.

As a result of many problems posed by the size and bulk of these machines, optimization of the number of destinations and thus of the number of receptacles in the machine has been effected. Accordingly the number of receptacles of the machine has been reduced, which leads to an increase in the number of sorting passes, i.e. the number of times the mail is reintroduced into the machine after having been subjected to a sort. Thus, because of the reduction in the number of receptacles, it is no longer possible to assign one receptacle to each final destination (i.e. to each address for example). It is thus necessary to regroup the destinations in sets and even to regroup the sets into groups of sets, each group then being capable of assignment to a receptacle.

To prepare the postman's walk involves sorting and ordering the mail in accordance with an order to be scrupulously observed: the ordering of the mail should correspond precisely to the actual path followed by the postman and this ordering should be strictly observed throughout the sorting operations.

Depending on the number of letters to be sorted, the number of destinations, the selected sorting method, etc., several successive sorting passes are thus provided and carried out.

The operating procedures in preparing the postman's walk will now be illustrated with the aid of an example. The following analogy is taken: it is desired to sort the 52 cards of a pack of cards observing the following two criteria:

the values of the cards, for example in an arbitrary increasing order as follows: ace, 2, 3, 4, 5, 6, 7, 8, 9, 10, jack, queen, king.

the values of the suits, for example in the following order: hearts, diamonds, spades, clubs.

The sort is effected in two passes.

First pass

The first pass is effected taking the values of the cards as criterion. Thirteen receptacles are thus used. We obtain for example:

| Receptacle 1 | Receptacle 2 | ... | Receptacle 13 |
|---|---|---|---|
| ace of hearts | 2 of spades | ... | king of clubs |
| ace of diamonds | 2 of clubs | ... | king of hearts |
| ace of clubs | 2 of hearts | ... | king of diamonds |
| ace of spades | 2 of diamonds | ... | king of spades |

The pack located in the receptacles is then picked up, preserving the order of the receptacles:

Receptacle 1, Receptacle 2, . . . , Receptacle 13.

Second pass

The second pass is effected taking the values of the suits as criterion. Four receptacles are thus used.

| Receptacle 1 | Receptacle 2 | ... | Receptacle 4 |
|---|---|---|---|
| ace of hearts | ace of diamonds | ... | ace of clubs |
| 2 of hearts | 2 of diamonds | ... | 2 of clubs |
| \| | \| | | \| |
| king of hearts | king of diamonds | ... | king of clubs |

The pack disposed in the receptacles is then picked up, preserving the order of the receptacles and preserving the order of the cards within each receptacle. The desired order is thus obtained.

It will be understood that there are two main factors which have to be satisfied for the sort to be correct:

not mixing the order of the receptacles between the first and second passes, nor after the second pass, maintaining the order of the cards within each receptacle.

If we revert to the case of sorting mail, the son should be effected observing for example:

the zip code of the town, the name of the road, the numbers in the road (in decreasing order for example), the parity of the numbers, etc.

The walk of a postman comprises on average 3000 letters and about 800 stops. These 800 stops correspond for example to 800 buildings or houses. As has been indicated above, if it were desired to effect the sort directly by assigning one receptacle per stop, it would be necessary to use a very large machine, which is not suitable for a small sorting office, such as a local post office. The number of receptacles is thus limited to 10, which leads to classification of the 800 stops into 8 groups, each containing 10 "bunches". Each bunch thus contains 10 stops.

Thus, each letter assigned to a stop may be identified by three integers: that of the group to which it belongs, lying between 1 and 8 and denoted g, that of the bunch to which it belongs, lying between 1 and 10 and denoted b (for "bunch"), and that of the stop to which it is destined, lying between 1 and 10 and denoted s (for "stop"). It will be noted that in the sequence Lgbs, the letter L is assigned to the stop s of the bunch b in the group g.

The sort should thus observe three distinct criteria: it is effected in three passes as will now be briefly described.

First pass

Each receptacle (also known as a stuffer or stacker because the letters are lined up against one another and form a stack) is assigned to a stop number. At the end of the pass, we obtain:

| | |
|---|---|
| Receptacle 1: | Lgb1, irrespective of g and b |
| Receptacle 2: | Lgb2, irrespective of g and b |
| \| | \| |
| Receptacle 10: | Lgb10, irrespective of g and b |

The letters contained in the receptacles are transferred in stacks in a feed magazine of the sorting machine. The order of the receptacles and that of the letters in the receptacles should be strictly preserved.

Second pass

Each receptacle is assigned to a bunch number. At the end of the pass we obtain:

| Receptacle 1 | Receptacle 2 | ... | Receptacle 10 |
|---|---|---|---|
| Lg1,1 | Lg2,1 | ... | Lg10,1 |
| Lg1,2 | Lg2,2 | ... | Lg10,2 |
| Lg1,3 | Lg2,3 | ... | Lg10,3 |
| \| | \| | | \| |
| Lg1,10 | Lg2,10 | ... | Lg10,10 |

regardless of what g is in each receptacle.

The letters contained in the receptacles are transferred in piles to the feed magazine. The order of the receptacles and that of the letters in the receptacles must be strictly preserved.

Third pass

Each receptacle is assigned to a group number. The sort is then effected over 8 receptacles and, at the end of the third pass, we obtain:

| Receptacle 1 | Receptacle 2 | ... | Receptacle 8 |
|---|---|---|---|
| L1,1,1 | L2,1,1 | ... | L8,1,1 |
| L1,1,2 | L2,1,2 | ... | L8,1,2 |
| L1,1,3 | L2,1,3 | ... | L8,1,3 |
| \| | \| | | \| |
| L1,2,1 | L2,2,1 | ... | L8,2,1 |
| L1,2,2 | L2,2,2 | ... | L8,2,2 |
| \| | \| | | \| |
| L1,10,1 | L2,10,1 | ... | L8,10,1 |
| L1,10,2 | L2,10,2 | ... | L8,10,2 |
| \| | \| | | \| |
| L1,10,10 | L2,10,10 | ... | L8,10,10 |

The letters contained in the receptacles are finally picked up, then ordered. The order of receptacles and that of the letters in the receptacles must be strictly preserved.

In practice, several letters can be identified by one triplet (g, b, s). However the method of testing in three passes does not take account of the number of letters per stop and starts with the assumption that the distribution of letters per stop is uniform. It will thus be understood, as has be established in simulations of the method, that there can be overflow of one or more receptacles during one of the passes. An overflow in a pass leads to failure of the final pass because, as has been seen, the sort of a pass is conditioned by the sort of the preceding pass.

The object of the present invention is thus to provide a method of sorting objects, in particular sorting objects in at least two passes, into receptacles of limited capacity, allowing the distribution of objects to be made uniform in the receptacles, thus avoiding overflows of the receptacles during one of the passes.

In particular, an object of the present invention is to distribute the mail contained in the receptacles uniformly in the last pass.

To this end the present invention proposes a method of sorting objects in N passes of physical distribution into R receptacles of a sorting machine controlled by control means, N being at least equal to two, characterized in that the method comprises the following steps:

reading and storing in memory in the control means coded information carried by the objects, the information comprising N distinct criteria per object, classifying the objects in memory in the control means in a given order such that each object is assigned to a destination, calculating in the control means the distribution of the objects in the receptacles, during an (N−1)'th canonical pass, i.e. such that all the objects which have the same value of a first of the criteria will be assigned to the same receptacle, calculating in the control means the distribution of the objects in the receptacles, during an N'th canonical pass, i.e. such that all the objects which have the same value of a second of the criteria will be assigned to the same receptacle, and that their order preserves the given order, making a first modification by the control means to the distribution of the N'th canonical pass, such that the number of objects in each of the receptacles will be made equal to P at the most, where P is the maximum number of the objects which can be contained in each of the receptacles, determining the contents of each of the receptacles in which the objects should be found at the end of a provisional (N−1)'th pass, performed in such a manner as to achieve the modified distribution of the N'th pass, making a second modification of The distribution of the N'th modified pass, providing a definitive distribution of the N'th pass, if the contents of one of the receptacles should be found to exceed P at the end of the provisional (N−1)'th pass, such that the order of the objects stays the same as the given order and that the distribution of a definitive (N−1)'th pass is performed in such a manner as to allow the distribution of the definitive N'th pass to lead to the receptacles each containing at most P objects, repeating all the preceding steps with N replaced by N−1 and N−1 by N−2, and so on until the last two of the passes to be modified, sorting the objects by means of the machine according to the definitive distributions which have been determined.

Thanks to the method of the invention, none of the receptacles overflows in the various passes which are performed.

If $R^N$ is always greater than the number of the destinations, the first modification comprises the following steps for example:

selection of the receptacle of the N'th canonical pass whose contents exceed P and which is fuller than the rest, assigning one of the objects from this receptacle to the following receptacle, without altering the given order of the objects, reiterating the selection and the assignment if the contents of one of the receptacles of the N'th canonical pass exceed P, attributing in memory to each of the receptacles of the modified N'th pass a number of objects referred to as real corresponding to the number of objects contained in each of the receptacles, and a number referred to as fictitious corresponding to the difference between P and the real number of objects, initiating the step of determination when absolutely none of the receptacles of the N'th canonical pass has contents greater than P.

The second modification may then comprise the following steps:

a first selection step of the receptacle of the provisional (N−1)'th pass whose contents exceed P and which is fuller than the rest, a second selection step of the receptacle of the modified N'th pass which is the least full and contains the most fictitious objects, considered as not processed, a third search step in the receptacle of the modified N'th pass selected in the second step for a fictitious object referred to as a candidate whose position in the selected receptacle indicates that it came from the receptacle of the provisional N'th pass selected in the first step, a fourth selection step, if the candidate fictitious object exists, of a receptacle of the modified N'th pass which is least full containing the most fictitious objects considered as not processed and distinct from the receptacles of the modified N'th pass the least full and containing most fictitious objects considered as not processed already selected during the second step or the fourth step, the second modification resuming from the third step if a receptacle exists selected in the fourth step, a fifth selection step, if there is no selected receptacle in the fourth step, of a receptacle of the provisional (N−1)'th pass whose contents exceed P, fuller than all the rest and distinct from the receptacles of the provisional (N−1)'th pass whose contents exceed P and which is the fullest already selected during the second step or in the fifth step, then return to the second modification starting from the second step, a sixth step, initiated if the candidate fictitious object does not exist, which signifies that a real object has a position in the selected receptacle of the modified (N−1)'th pass which indicates that it provided the selected receptacle of the (N−1)'th pass in the first step, of replacing the real object by a fictitious object of the receptacle of the modified N'th pass, while preserving the order of the real objects, a seventh step of attributing the property "processed" to the candidate fictitious object, reiteration of the preceding steps of the number of "processed" fictitious objects is less that the initial total number of fictitious objects.

Thanks to the artifice of fictitious objects used during the first and second modifications, all the receptacles are used during all the passes, which allows the best possible usage of the available space in the receptacles to avoid any overflow.

According to a variant, the step of reading can have taken place in a first passage of the objects through the machine, effected according to a specific criterion, the last two passes to be modified then being the third and second passes. The specific criterion is for example a statistical criterion. It may also be one of the N preceding criteria.

In another case, the two last passes to be modified may be the second and first passes.

In one possible application of the method according to the invention, the sort is a three-pass son destined to sort L letters of a postman, and the reading is preceded by distribution of the L letters into G groups of B bunches each, each of the bunches containing S stops of the letters, such that each of the letters carries a group number from 1 to G, a bunch number from 1 to B and a stop number from 1 to S, each of the bunches constituting one of the objects, the first criterion corresponding to assigning one of the objects to each receptacle and of attributing to this receptacle all the bunches pertaining to the corresponding group, and the second criterion corresponding to assigning all the letters carrying the same bunch number to each receptacle.

Advantageously, if after the reading, it should prove that the distribution leads to S consecutive stops containing no letters, the S stops are regrouped to be assigned to a fictitious supplementary object and the distribution is carried out again. This enables better utilization of the available space in the receptacles.

Finally, according to a major improvement, each of the modifications is followed by an optimizing step of the contents of each of the receptacles. This optimization is obtained by maximizing or minimizing a function whose extreme corresponds to an optimum redistribution of the contents of the receptacles. This function is defined for example as the sum, for each of the receptacles of the difference between the contents of a receptacle and the average contents of the receptacles.

This optimization is for example a simulated annealing for which the applied perturbations are shifts of the fictitious objects.

This improvement allows the final contents of the receptacles to be rendered homogeneous, so that each receptacle contains approximately the same number of objects. Moreover the method of simulated annealing is particularly well suited to processing integers.

Other features and advantages of the present invention will appear from the following description of a method in accordance with the invention, given by way of example and without any limitation.

Figure 1:
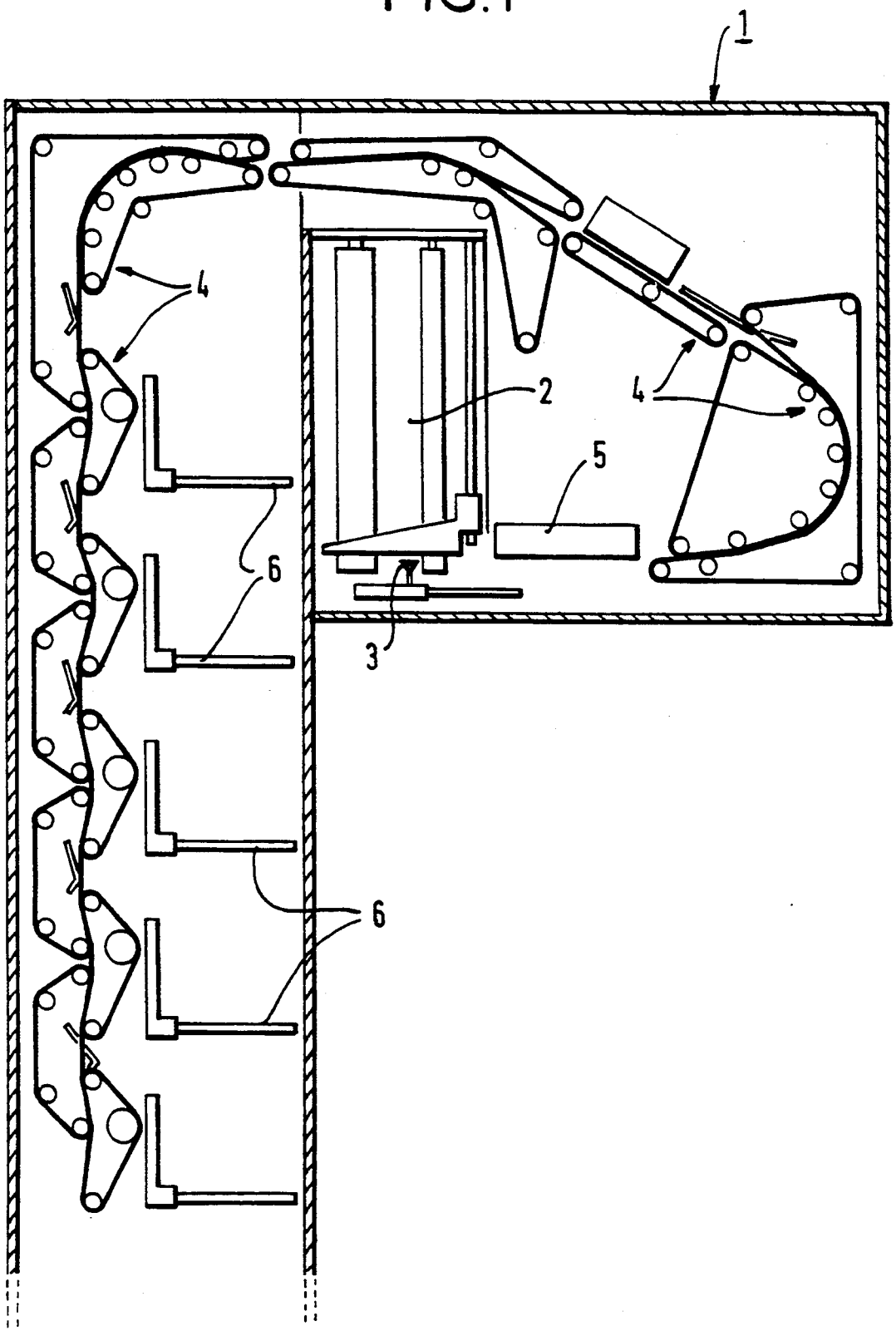
FIG. 1 is a schematic view from above of an automatic mail sorting machine.

An automatic mail sorting machine 1 is shown in FIG. 1. The machine 1 comprises the following parts:

a feed magazine 2 in which the operator places the mail to be processed. The mail is then extracted to be presented in front of a stack feeder 3, a stack feeder 3 whose function is to separate the letters from one another and to feed them one by one to a conveyor system 4, a read head 5 associated with a microprocessor (not shown) for controlling and sequencing the machine 1, and facing the conveyor system 4 so as to identify each letter and to assign it to a sorting receptacle 6, a series of receptacles 6, namely ten sorting receptacles of which only five are shown, a mechanical rejection receptacle for letters which do not correspond to a standard format, a rejection receptacle for an illegible code on the letter, and an overflow receptacle (these last three receptacles not being shown).

We will now deal with the detailed description of the successive steps of the method of the invention.

To illustrate the operations carried out in accordance with this method, the previously used example is selected, in which about 3000 letters addressed to 800 stops are sorted. The 800 stops are distributed in bunches and groups. The sort is carried out with a machine having ten receptacles, in three passes.

Figure 2:
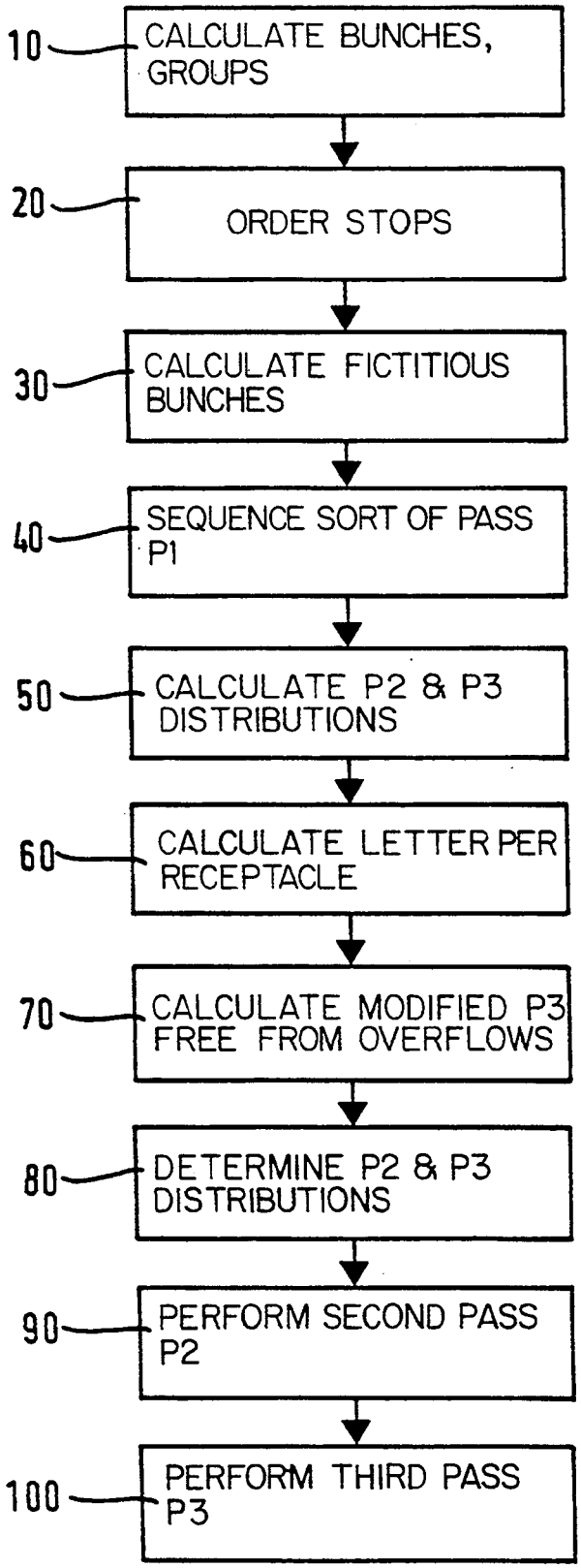
FIG. 2 is a block flow chart of the main steps of the method of the invention.

FIG. 2 is an overall block flow chart showing the successive main steps in the method of the invention. This method consists in a calculation carried out by a stored program by means of the sequencing microprocessor of the sorting machine. This calculation determines the physical distribution of letters to be carried out by the machine.

In what follow, passes which are carried out or are simulated in accordance with the method of the prior art sort are called canonical passes.

The data known from the start and given to the processing program are:

the number L of letters to be sorted, the number S of stops, the number R of receptacles of the sorting machine.

On the basis of this data, the processing of the invention comprises the following successive steps, namely:

step 10, calculate the number of bunches B and the number of groups required for the sort in three conventional passes, as well as the assignment of the stops to bunches and of the bunches to groups. In the example considered, the result of the step 10 is the distribution of 800 stops in eight groups of ten bunches each, with ten stops per bunch, step 20, order the stops by the microprocessor in accordance with an order which must be obtained at the end of the sorting, step 30, calculate the difference between the total number of bunches which can be contained in the receptacles and the number of bunches actually used for the sort in the canonical sort using the fewest receptacles; this difference leads to a number of bunches called fictitious bunches BF. The number of fictitious bunches can be calculated according to the following formula:

$$BF=R\times BR-B,$$

where BR is the number of bunches which can be contained in a receptacle.

In the example chosen it has been seen that only eight receptacles of the ten are used in the third canonical pass, if there are 80 bunches referred to as real. Since two receptacles, provided to contain 10 bunches each are thus available, 20 fictitious bunches are created, each of ten stops.

The use of fictitious bunches allows the mail to be distributed more uniformly in the receptacles, as will be explained in more detail in the following, in order to avoid possible overflows, step 40, sequence the sort of the first canonical pass P1 and record the data carried by each object, in order to determine their distribution. The distribution of the letters by stop being unknown before the first canonical pass, this takes place as in the method of the prior art. At the end of the first canonical pass, each receptacle thus contains all the letters having the same stop number and it is assumed for simplicity that the first pass does not lead to any receptacle overflow. During this pass, all the letters file past the read head to be assigned to a receptacle. Thus the information containing the three sort criteria and present on each envelope or on each wrapper (in the form of a bar code for example) is read and then stored and entered in memory in the sequencing microprocessor., step 50, calculate, by means of the microprocessor, the redistribution of the objects into the receptacles during the second and third canonical passes. These distributions are calculated according to the two criteria which the first canonical pass has not used, i.e., the criteria of bunch and of group, step 60, determine in accordance with the distribution calculated in the preceding step, the number of letters contained in the receptacles of the third canonical pass, step 70, effect a first modification of the distribution of the third canonical pass, so as to obtain a modified distribution of the third pass, such that no receptacle will ovelflow, step 80, deduce from the distribution calculated in the step 70 a definitive distribution of the second and third passes such that neither of these two passes leads to overflow of the receptacles.

step 90, sequence the sorting machine so that it performs the second pass P2 according to the definitive distribution calculated in step 80, step 100, sequence the sorting machine so that it performs the third pass P3 according to the definitive distribution calculated in step 80.

The operation of the steps 70 and 80, characteristics of the processing in accordance with the invention, will now be detailed.

Figure 3:
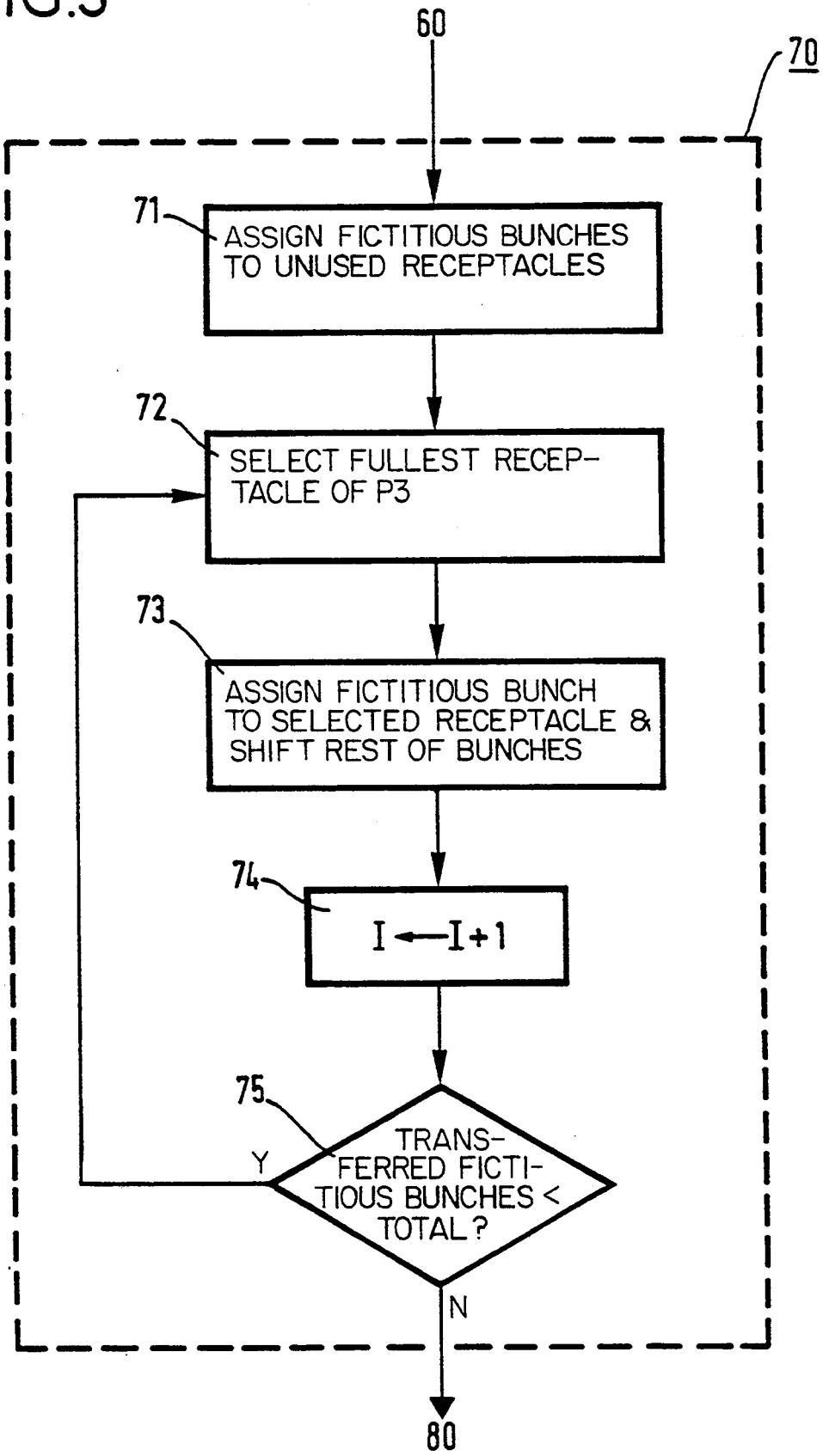
FIG. 3 is a block flow chart of the successive steps forming the step 70 of FIG. 2.

FIG. 3 is a block flow chart of successive operations constituting the step 70. The processing of step 70 uses all of the preceding data as well as the data on the contents (letters) of each receptacle of the third canonical pass determined during step 60. This processing consists in:

step 71, assign the fictitious bunches to the unused receptacles during sort of the third canonical pass, step 72, select the fullest receptacle of the third canonical pass, (i.e. contains the largest number of letters), step 73, assign a fictitious bunch to this receptacle, following the real bunches, which results in shifting all the bunches in order to preserve their relative order and assigning one of them to the first empty receptacle, step 74, increment the variable I corresponding to the number of fictitious bunches thus transferred, step 75, compare I with the number BF of available fictitious bunches: if I is less than BF, the processing reiterates steps 72 to 75; if I is equal to BF, the processing proceeds to step 80.

It is preferable in fact to shift all of the fictitious bunches, in order to avoid overflows in the second and third passes. However it is also possible to pass on to processing step 80 as soon as each of the receptacles of the third pass contain either only real bunches or real and fictitious bunches at the same time, but never solely fictitious bunches.

The processing of the step 70 thus results in distribution of the contents of the receptacles of the third canonical pass in all the available receptacles, thanks to the artifice of fictitious bunches. Each receptacle then contains the maximum number of bunches for which it is provided and these bunches may be real or fictitious bunches. This operation has no effect on the mandatory ordering of the bunches which is to be preserved, since it consists in practice in inserting "voids" in the receptacles. The order of bunches provided by the conventional sorting method is thus preserved.

In order to illustrate what has been described, we return to the selected example. The conventional method provides, for the third canonical pass, distribution of 80 real bunches (denoted B0 to B79) among the first eight receptacles for example (R0 to R7). The processing of the invention starts from the following distribution of the third canonical pass (denoting the 20 fictitious bunches BF1 to BF20):

| | | | | | |
|---|---|---|---|---|---|
| R0 | R1 | ... | R7 | R8 | R9 |
| B0 | B10 | ... | B70 | BF1 | BF11 |
| \| | \| | | \| | \| | \| |
| B9 | B19 | ... | B79 | BF10 | BF20 |

Assume that the step 72 selects R0 as the fullest receptacle of the third canonical pass, the result of step 73 is then:

| | | | | | | |
|---|---|---|---|---|---|---|
| R0 | R1 | R2 | ... | R7 | R8 | R9 |
| B0 | B9 | B19 | ... | B69 | B79 | BF11 |
| \| | \| | \| | | \| | BF2 | \| |
| B8 | \| | \| | | \| | \| | \| |
| BF1 | B18 | B28 | ... | B78 | BF10 | BF20 |

We now have I=1. Since BF=20, the processing repeats step 72. Assume that this step again selects the receptacle R0 as being the fullest. The result of step 73 is now:

| | | | | | | |
|---|---|---|---|---|---|---|
| R0 | R1 | R2 | ... | R7 | R8 | R9 |
| B0 | B8 | B18 | ... | B68 | B78 | BF11 |
| \| | \| | \| | | \| | B79 | \| |
| B7 | \| | \| | | \| | BF3 | \| |
| BF1 | \| | \| | | \| | \| | \| |
| BF2 | B17 | B27 | ... | B77 | BF10 | BF20 |

We have I=2. The processing returns to step 72.

Once all the fictitious bunches have been distributed, de-stacking the receptacles at the end of the third pass and their arrangement in order leads to preservation of the mandatory order of the real bunches. It will be understood that the positions of the fictitious bunches within a receptacle are of no significance in relation to the relative positions of the real bunches in the receptacle. On the contrary, this concerns a modification of the contents of the receptacles in the second canonical pass.

The processing of the step 80 is designed to provide the contents of the receptacles of the second pass, knowing that the real contents of the receptacles of the third pass obtained as a result of the step 70 are not to be modified any more.

Figure 4:
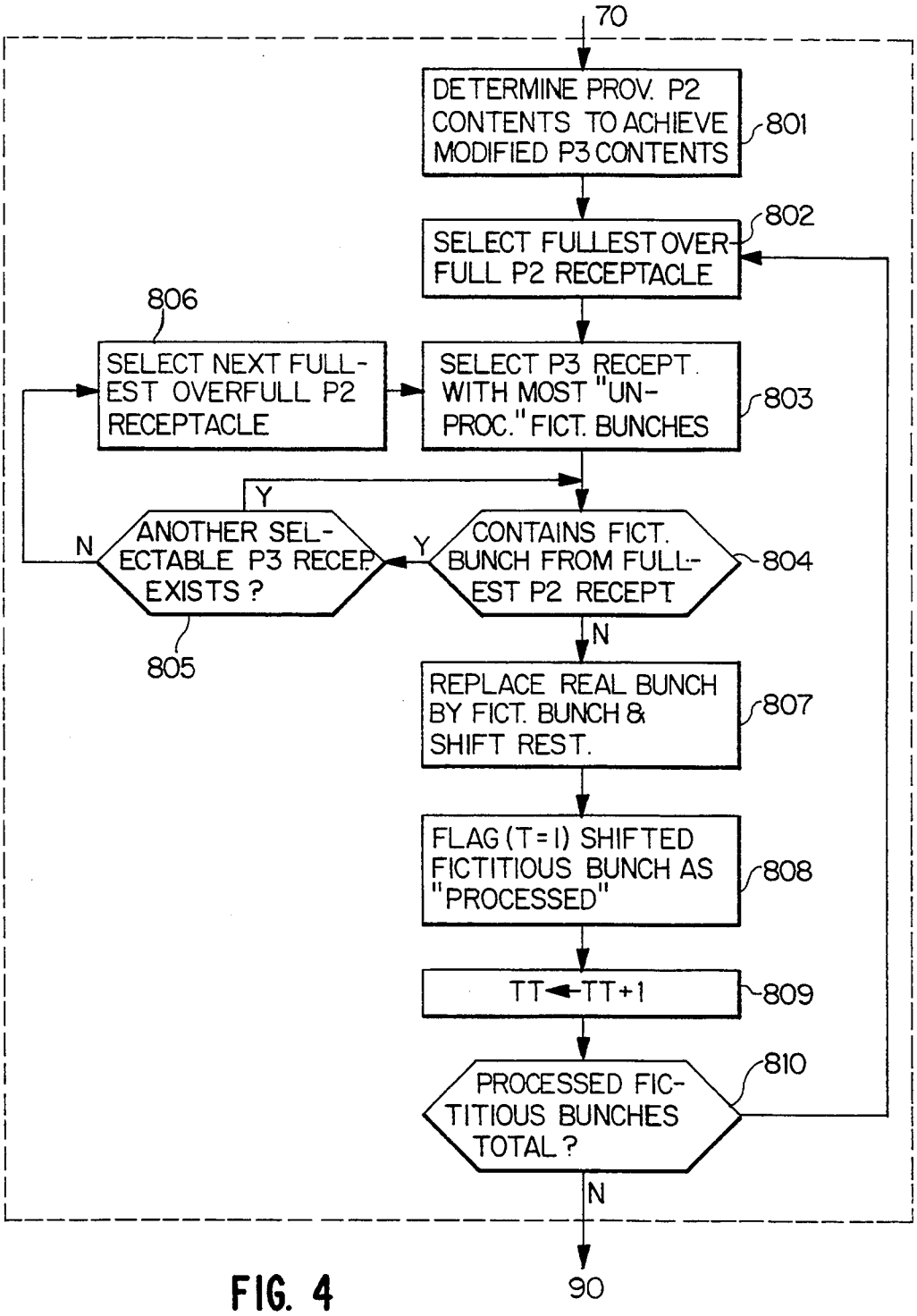
FIG. 4 is a block flow chart of the successive steps forming the step 80 of FIG. 2, FIGS. 5 to 9 are explanatory tables for certain steps of the method of the invention.

FIG. 4 is a block flow chart of the successive operations constituting step 80. This processing consists in:

step 801, determine the contents of each of the receptacles in which the real and fictitious bunches should be found at the end of a provisional second pass performed in such a manner as to allow the distribution of the modified third pass to be obtained in step 70, step 802, select the receptacle of the provisional second pass which is the fullest and contains more letters than are allowed by its maximum contents, step 803, select the receptacle of the modified third pass containing the most fictitious bunches not yet shifted or "processed" by the processing of step 80. If there are several receptacles meeting this criterion, it is preferred to select that which will, after the processing of step 807 (see below), allow the greatest reduction in the contents of the selected receptacle of the second pass, step 804, search to see if there exists within the receptacle of the modified third pass containing most non-processed fictitious bunches a fictitious bunch whose position in this receptacle of the modified third pass indicates that is came from the fullest receptacle of the provisional second pass, step 805, initiated if the fictitious bunch sought for in the step 804 exists, search to see if there is a receptacle of the modified third pass meeting the criterion of step 803 and different from those previously found in this step; if such a receptacle exists, the processing reverts to step 804, step 806, initialed if there is no longer any receptacle of the modified third pass meeting the criterion of step 803, select another receptacle of the provisional second pass meeting the criterion of step 802 and different from those previously chosen in this step, then again effecting the processing starting from step 803, step 807, initialed if the fictitious bunch sought for in step 804 does not exist, replace the real bunch of the selected receptacle of the modified third pass whose position in this receptacle indicates that it came from the fullest receptacle of the provisional second pass by a fictitious bunch of the selected receptacle of the modified third pass, and shifting all the other bunches of the receptacle of the modified third pass so as to preserve their relative order. The result of this operation thus is to remove one bunch from the fullest receptacle of the provisional second pass and replace it by a fictitious bunch, thus reducing its contents, step 808, assign a value (for example T=1) to the fictitious bunch shifted in the preceding step, indicating that this bunch has been "processed" and should not in consequence be shifted in the following processing, step 809, incrementing the variable corresponding to the number TT of processed fictitious bunches, i.e. which have been assigned the value T=1, step 810, compar TT with the number BF of available fictitious bunches: if the two numbers are equal, the processing passes to step 90; if TT is strictly less that BF, processing reverts to step 802.

It is desirable to give an illustration by an example of the processing effected in step 80. To do this, the state of the receptacles of the second and third passes is represented by a matrix or table with two entries.

FIGS. 5 to 9 illustrate different states of such a table. Each of the columns, numbered C0 to C9, represents one receptacle of the second pass. Each of the rows, numbered L0 to L9, represents a receptacle of the third pass, i.e. a group.

In FIG. 5, there is shown the table representing the state of the receptacles of the second and third canonical passes.

The sort of the second canonical pass leads to assignment of a bunch number to each receptacle; all the bunches corresponding to the index b=1 for example in the various groups are re-grouped in the receptacle R0 (column C0). In practice, the bunches indexed b=1 are for example B0, B10, B20, B30, . . . B70.

The sort of the third canonical pass lead to assignment of a group number; thus the ten bunches of the first group, for example, are re-grouped in order in the receptacle R0 (row L0).

FIG. 6 is a table representing one possible state of the receptacles of the modified third pass calculated in step 70.

In this example, it is assumed that the receptacle R3 (column C3) is the fullest receptacle of the provisional second pass. The result of the step 803 is selection of the receptacle R2 of the third pass (row L2), which has four fictitious bunches BF4, BFS, BF6, BF7 while the other receptacles of the modified third pass possess three at the most. In the receptacle R2 of the modified third pass (row L2), none of the four fictitious bunches came from the receptacle of the provisional second pass R3; (they pertain to the receptacles R6, R7, R8 and R9 respectively of the provisional second pass). We thus pass on to the step 807. It leads to placing BF4 in the position B20 and shifting B20 and all the following bunches so as to preserve their relative order. The table of FIG. 7 illustrates the results of this step. It will be understood however that the relative order of the bunches in the selected receptacle of the modified third pass, (R2, row L2), is not modified in practice. After this processing, the fictitious bunch BF4 is "processed": it cannot be shifted any more. After the step 809, the variable TT is equal to 1 and BF is equal to 20. The processing therefore reverts to step 802.

Assume that the fullest receptacle of the provisional second pass is at present R1 (column C1). Several receptacles of the modified third pass contain the same number of fictitious bunches not yet processed. We again select as the most instructive example the receptacle R2 of the modified third pass (row L2) as the result of step 803. In this receptacle R2 of the modified third pass (row L2), no fictitious bunch already belongs to the receptacle R1 of the provisional second pass (column C1): we therefore pass on to step 807. This leads to placing BF5 in the position of B18 and shifting B18 and all of the following bunches capable of being shifted (i.e. with the exception of BF4) so as to preserve the relative order. The table of FIG. 8 illustrates the results obtained from this step.

The processing proceeds until all the fictitious bunches have been "processed".

We will now examine the case of another possible state of the receptacles of the modified third pass from step 70. The table illustrating this state is again shown in FIG. 6 but it is now assumed that the fullest receptacle of the provisional second pass is the receptacle R6 (column C6). The receptacle of the modified third pass containing the largest number of fictitious bunches is still R2 (row L2), resulting from step 803. This time there is already a fictitious bunch BF4 pertaining to the fullest receptacle R6 of the provisional second pass (column C6) in the receptacle R2 of the modified third pass (row L2). Step 805 thus follows step 804. Its result is the receptacle R1 of the modified third pass (roe L1), which has not yet been found in step 803. This receptacle of the modified third pass does not contain a fictitious bunch pertaining to the receptacle R6 of the provisional second pass (column C6). We can therefore pass on to the step 807, which leads to the result illustrated by the table of FIG. 9.

The definitive distributions obtained after the calculations of step 80 condition the operations of the sorting machine during the second and third physical passes, by controlling these passes during steps 90 and 100.

Thus, as a result of the reelhod of sorting of the invention, no receptacle overflows during the second and third passes. This great advantage allows automatic sorting machines to be used effectively with three passes. These machines are not actually being used at the present time because of the problems of overflows created by the method of three-pass sorting of the prior art. The method of the invention thus represents a significant financial benefit. It also represents a saving in time, because it uses a fast sorting machine.

Furthermore the calculations effected between the first and second passes do not increase the time required for the other operations effected between these two passes, i.e. the time in which the operator (or the machine) transfers the contents of the receptacles from the first pass to the feed magazine. Thus this transfer time is around 1 minute, 30 seconds while the calculation time is at most fifteen seconds.

The method of the invention is clearly particularly suitable for postal sorting in three passes. However it is not limited to this sorting and can apply to sorting any objects in at least two passes according to at least two distinct criteria (one sorting criterion being assigned to each canonical pass), when the receptacles of the sorting machine are smaller in number that the number of objects to be sorted and there is a risk of overflow of these receptacles. In order to be able to apply the method of the invention it is thus necessary for the number of objects to be sorted to be less than the total capacity of the sorting machine. This allows use of the artifice of fictitious sets like the fictitious bunches. More particularly, the method of the invention can be applied if $R^N > S$ for sorting letters into S stops in N passes in a machine with R receptacles.

For a son in N passes, we start by carrying out the processing of the invention on the N'th and (N−1)'th passes, then on the (N−1)'th and (N−2)'nd passes, and so on until the last passes which it is desired to modify.

In practice there are several cases to consider for the first pass.

In a first case, a statistical distribution of the letters is known, which allows the assignment of each stop to be made in the first pass (or during a first passage of the letters through the machine). In general, this assignment does not involve overflows, because it takes into account the statistical results of previous sorts. If however, overflows have taken place during this first pass, it is sufficient to modify the assignment in such a manner as to avoid these overflows. The recording of the information carried by the letters is effected during this first pass.

In a second case, the first pass is effected according to the canonical criteria mentioned in the introduction. This is the hypothesis chosen for the step 40 previously described. If such a pass leads to overflows, it is carried out again with a modification to the assignments which depends on the information recorded during the first pass.

Finally, in a third case, the information carried by the letters is read and recorded as a preliminary to all the passes. From then on the method of the invention is applied to all the passes, apart from the last, considered two-by-two. This leads finally to an optimized distribution for all the physical passes.

This method can be applied for example to routing photographic films in a developing unit.

Clearly the method of the invention is not limited to the preceding description.

In particular, if it is observed that, after the first physical pass, ten consecutive stops contain no letters, it is possible to suppress these ten stops, shifting the numbering of the following stops so as to create a supplementary fictitious bunch.

Furthermore it is possible to improve the processing effected in the operations 70 and 80. This processing allows overflows to be avoided. It can however be desirable also that each receptacle contains stacks of substantially the same sizes, because this facilitates the work of the operator before transferring them into the feed magazine. For this an optimizing operation can be effected after the step 70 and after the step 80, by a method of optimization used conventionally. The object of this optimization is for example to minimize the function F referred to as the cost function defined as the sum over all receptacles of the second or third pass of the square of the difference between the contents of a receptacle and the mean contents of all the receptacles. In order to minimize the function F there may be used for example a method of optimization by simulated annealing well known to the person skilled in the art and described in the article entitled "Le recuit simulé" [Simulated annealing] by Ernesto Bonomi and Jean-Luc Lutton, appearing in *Pour la Science,* No 129, July 1988, pages 68 to 77. In this case, shifts of the fictitious bunches may be chosen as perturbations, for example.

It is also possible to use any other known method of optimization, such as the method of slopes. However, the method of simulated annealing is better adapted to handling integers.

We claim:

1. A method of sorting objects in N passes of physical distribution into R receptacles of a sorting machine controlled by control means, N being at least equal to two, characterized in that the method comprises the following steps:

reading and storing in memory in said control means coded information carried by said objects, said information comprising N distinct criteria per object, classifying said objects in memory in said control means in a given order such that each said object is assigned to a destination, calculating in said control means the distribution of said objects in said receptacles, during an (N−1)'th canonical pass, such that all the objects which have the same value of a first of said criteria will be assigned to the same receptacle, calculating in said control means the distribution of said objects in said receptacles, during an N'th canonical pass, such that all the objects which have the same value of a second of said criteria will be assigned to the same receptacle, and that their order preserves said given order, making a first modification by said control means to said distribution of said N'th canonical pass, such that the number of objects in each of said receptacles will be made equal to P at the most, where P is the maximum number of said objects which can be contained in each of said receptacles, determining the contents of each of the receptacles in which said objects should be found at the end of a provisional (N−1)'th pass, performed in such a maretar as to achieve said modified distribution of the N'th pass, making a second modification of said distribution of the N'th modified pass, providing a definitive distribution of the N'th pass, if the contents of one of said receptacles should be found to exceed P at the end of said provisional (N−1)'th pass, such that the order of said objects stays the same as said given order and that the distribution of a definitive (N−1)'th pass is performed in such a manner as to allow said distribution of the definitive N'th pass to lead to the receptacles each containing at most P objects, repeating all the preceding steps with N replaced by N−1 and N−1 by N−2, and so on until the last two of the passes to be modified, sorting said objects by means of said machine according to the definitive distributions which have been determined.

2. A method according to claim 1, characterized in that, if $R^N$ is always greater than the number of said destinations, said first modification comprises the following steps:

selection of the receptacle of said N'th canonical pass whose contents exceed P and which is fuller than the rest, assigning one of said objects from this receptacle to the following receptacle, without altering the given order of said objects, reiterating said selection and said assignment if the contents of one of said receptacles of said N'th canonical pass exceed P, attributing in memory to each of said receptacles of said modified N'th pass a number of objects referred to as real corresponding to the number of objects contained in each of said receptacles, and a number referred to as fictitious corresponding to the difference between P and said real number of objects, initiating said step of determination when absolutely none of said receptacles of said N'th canonical pass has contents greater than P.

3. A method according to claim 1, characterized in that said second modification comprises the following steps:

a first selection step of the receptacle of said provisional (N−1)'th pass whose contents exceed P and which is fuller than the rest, a second selection step of the receptacle of said modified N'th pass which is the least full and contains the most fictitious objects, considered as not processed, a third search step in said receptacle of said modified N'th pass selected in said second step for a fictitious object referred to as a candidate whose position in said selected receptacle indicates that it came from said receptacle of the provisional N'th pass selected in said first step, a fourth selection step, if the candidate fictitious object exists, of a receptacle of said modified N'th pass which is least full containing the most fictitious objects considered as not processed and distinct from said receptacles of said modified N'th pass the least full and containing most fictitious objects considered as not processed already selected during said second step or said fourth step, said second modification resuming from said third step if a receptacle exists selected in said fourth step, a fifth selection step, if there is no selected receptacle in said fourth step, of a receptacle of said provisional (N−1)'th pass whose contents exceed P, fuller than all the rest and distinct from said receptacles of said provisional (N−1)'th pass whose contents exceed P and which is the fullest already selected during said second step or in said fifth step, then return to said second modification starting from said second step, a sixth step, initiated if said candidate fictitious object does not exist, which signifies that a real object has a position in said selected receptacle of the modified (N−1)'th pass in which indicates that if provided said selected receptacle of said (N−1)'th pass in said first step, of replacing said real object by a fictitious object of the receptacle of said modified N'th pass, while preserving the order of said real objects, a seventh step of attributing the property "processed" to said candidate fictitious object, reiteration of said preceding steps of the number of "processed" fictitious objects is less that the initial total number of fictitious objects.

4. A method according to claim 1, characterized in that said reading takes place in a first passage of said objects in said machine, effected according to a specific criterion, said last two passes to be modified then being the third and second passes.

5. A method according to claim 4, characterized in that said specific criterion is a statistical criterion.

6. A method according to claim 4, characterized in that said specific criterion is one of said N criteria.

7. A method according to claim 1, characterized in that said two last passes to be modified are the second and first passes.

8. A method according to claim 1, characterized in that said sort is a three-pass sort destined to sort L letters of a postman, and in that said reading is preceded by distribution of said L letters into G groups of B bunches each, each of said bunches containing S stops of said letters, such that each of said letters carries a group number from 1 to G, a bunch number from 1 to B, and a stop number from 1 to S, each of said bunches constituting one of said objects, said first criterion corresponding to assigning one of said objects to each receptacle and of attributing to this receptacle all the bunches pertaining to the corresponding group, and said second criterion corresponding to assigning all the letters carrying the same bunch number to each receptacle, wherein L, G, B, and S are integers.

9. A method according to claim 8, characterized in that if, after said reading, it should prove that said distribution leads to S consecutive stops containing no letters, said S stops are regrouped to be to be assigned to a fictitious supplementary object and said distribution is carried out again.

10. A method according to claim 1, characterized in that each of said modifications is followed by an optimizing step of the contents of each of said receptacles.

11. A method according to claim 10, characterized in that said optimization is obtained by maximizing or minimizing a function whose extreme corresponds to an optimum redistribution of the contents of said receptacles.

12. A method according to claim 11, characterized in that said function is defined as the sum, for each of said receptacles of the difference between the contents of a receptacle and the average contents of said receptacles.

13. A method according to claim 10, characterized in that said optimization is a simulated annealing.

14. A method according to claim 10, characterized in that said optimization is a simulated annealing for which the applied perturbations are shifts of said fictitious objects.

* * * * *